US009480115B2

(12) United States Patent
Bradford

(10) Patent No.: US 9,480,115 B2
(45) Date of Patent: Oct. 25, 2016

(54) DYNAMIC LIGHT EMITTING DEVICE (LED) LIGHTING CONTROL SYSTEMS AND RELATED METHODS

(71) Applicant: Cree, Inc., Durham, NC (US)

(72) Inventor: Everett Bradford, Apex, NC (US)

(73) Assignee: Cree, Inc., Durham, NC (US)

( * ) Notice: Subject to any disclaimer, the term of this patent is extended or adjusted under 35 U.S.C. 154(b) by 704 days.

(21) Appl. No.: 13/777,351

(22) Filed: Feb. 26, 2013

(65) Prior Publication Data

US 2014/0239848 A1 Aug. 28, 2014

(51) Int. Cl.
*H05B 33/08* (2006.01)

(52) U.S. Cl.
CPC ..... *H05B 33/0845* (2013.01)

(58) Field of Classification Search
CPC ..... H05B 33/0845
USPC ..... 315/148–152, 307
See application file for complete search history.

(56) References Cited

U.S. PATENT DOCUMENTS

2008/0106218 A1* 5/2008 Zulch ..... H05B 33/0845 315/291
2011/0121744 A1* 5/2011 Salvestrini et al. ..... H05B 33/0815 315/246
2011/0140612 A1* 6/2011 Mohan et al. ..... H05B 37/0218 315/149
2012/0268019 A1* 10/2012 Briggs ..... H05B 33/0854 315/158

* cited by examiner

*Primary Examiner* — Douglas W Owens
*Assistant Examiner* — Jonathan Cooper
(74) *Attorney, Agent, or Firm* — Jenkins, Wilson, Taylor & Hunt, P.A.

(57) ABSTRACT

Dynamic light emitting device (LED) lighting adjustment systems and related methods are disclosed. In one aspect, a method can receive, at an LED lighting fixture, a lighting adjustment signal corresponding to a target lighting level and determine a delta value that represents a difference between a current lighting level of the LED lighting fixture and the target lighting level and a step time value associated with the determined delta value. The method can further include adjusting the current lighting level of the LED lighting fixture to a new current lighting level for the duration of the step time value and repeating the determining and adjusting steps until the new current lighting level equals the target lighting level.

34 Claims, 8 Drawing Sheets

500

502

| Gradation Step | Brightness % |
|---|---|
| 0 | 0.097317059 |
| 1 | 0.1 |
| 2 | 0.102756907 |
| 3 | 0.105589819 |
| 4 | 0.108500833 |
| 5 | 0.1114921 |
| 6 | 0.114565833 |
| 7 | 0.117724307 |
| 8 | 0.120969856 |
| 9 | 0.124304883 |
| 10 | 0.127731853 |
| 11 | 0.131253301 |
| 12 | 0.134871833 |
| 13 | 0.138590124 |
| 14 | 0.142410925 |
| 15 | 0.146337062 |
| 16 | 0.150371438 |
| 17 | 0.154517039 |
| 18 | 0.15877693 |
| 19 | 0.163154263 |
| 20 | 0.167652274 |
| 21 | 0.172274291 |
| 22 | 0.177023734 |
| 23 | 0.181904113 |
| 24 | 0.186919041 |
| 25 | 0.192072225 |

504

| Gradation Step | Brightness % |
|---|---|
| 151 | 5.910899064 |
| 152 | 6.073857057 |
| 153 | 6.241307649 |
| 154 | 6.413374699 |
| 155 | 6.590185478 |
| 156 | 6.771870765 |
| 157 | 6.958564947 |
| 158 | 7.150406114 |
| 159 | 7.347536163 |
| 160 | 7.550100905 |
| 161 | 7.758250169 |
| 162 | 7.972137914 |
| 163 | 8.191922345 |
| 164 | 8.417766029 |
| 165 | 8.649836013 |
| 166 | 8.888303951 |
| 167 | 9.133346228 |
| 168 | 9.385144093 |
| 169 | 9.643883792 |
| 170 | 9.909756703 |
| 171 | 10.18295948 |
| 172 | 10.46369421 |
| 173 | 10.75216853 |
| 174 | 11.04859582 |
| 175 | 11.35319534 |
| 176 | 11.66619238 |

506

| Gradation Step | Brightness % |
|---|---|
| 230 | 50.66690889 |
| 231 | 52.06374847 |
| 232 | 53.49909761 |
| 233 | 54.974018 |
| 234 | 56.48960057 |
| 235 | 58.04696635 |
| 236 | 59.64726725 |
| 237 | 61.29168696 |
| 238 | 62.98144179 |
| 239 | 64.71778159 |
| 240 | 66.50199067 |
| 241 | 68.33538873 |
| 242 | 70.21933188 |
| 243 | 72.15521358 |
| 244 | 74.14446574 |
| 245 | 76.18855974 |
| 246 | 78.2890075 |
| 247 | 80.44736266 |
| 248 | 82.66522167 |
| 249 | 84.94422498 |
| 250 | 87.2860583 |
| 251 | 89.69245379 |
| 252 | 92.16519136 |
| 253 | 94.70610001 |
| 254 | 97.31705915 |
| 255 | 100 |

FIG. 5

602 604 600

| Delta Value | Step Time (ms) |
|---|---|
| 0 | 16.384 |
| 1 | 16.384 |
| 2 | 16.32 |
| 3 | 16.256 |
| 4 | 16.128 |
| 5 | 15.936 |
| 6 | 15.808 |
| 7 | 15.552 |
| 8 | 15.296 |
| 9 | 15.04 |
| 10 | 14.72 |
| 11 | 14.4 |
| 12 | 14.016 |
| 13 | 13.568 |
| 14 | 13.12 |
| 15 | 12.608 |
| 16 | 12.096 |
| 17 | 11.584 |
| 18 | 11.008 |
| 19 | 10.368 |
| 20 | 9.728 |
| 21 | 9.024 |
| 22 | 8.32 |
| 23 | 7.552 |
| 24 | 6.784 |
| 25 | 5.952 |
| 26 | 5.12 |
| 27 | 4.224 |
| 28 | 3.328 |
| 29 | 2.368 |
| 30 | 1.408 |
| 31+ | 0.384 |

FIG. 6

DYNAMIC LIGHT EMITTING DEVICE (LED) LIGHTING CONTROL SYSTEMS AND RELATED METHODS

TECHNICAL FIELD

The subject matter disclosed herein relates generally to light emitter systems and related methods. More particularly, the subject matter disclosed herein relates to dynamic light emitting device (LED) lighting control systems and related methods.

BACKGROUND

Light emitters, such as light emitting diodes or devices (LEDs), are solid state devices that convert electrical energy into light. LEDs are widely used in lighting systems that provide cost effective illumination in commercial and residential locations. Currently, digital dimming systems for adjusting the brightness of LED are being utilized to control and manage the aforementioned LED-based lighting systems. However, due to the digital nature and the discrete levels/steps of brightness that are characteristic of these LED control systems, certain illumination problems can arise during normal operation. For example, it is not uncommon for the illumination emitted by an LED light fixture to visually "jump" to each discrete level as a control switch (e.g., a dimmer slider) is adjusted. Typically, viewing such an uneven transition between distinct levels of illumination is quite noticeable and, in some instances, unpleasant to the human eye.

Accordingly, there exists a need for dynamic LED lighting control systems and related methods.

SUMMARY

In accordance with this disclosure, novel dynamic light emitting device (LED) lighting control systems and related methods are disclosed herein. It is, therefore, an object of the disclosure herein to provide exemplary systems and methods that can comprise receiving, at a LED lighting fixture, a lighting adjustment signal corresponding to a target lighting level and determining a delta value that represents a difference between a current lighting level of the LED lighting fixture and the target lighting level and a step time value associated with the determined delta value. The method further comprises adjusting the current lighting level of the LED lighting fixture to a new current lighting level for the duration of the step time value and repeating the determining and adjusting steps until the new current lighting level equals the target lighting level.

The subject matter described herein can be implemented in hardware, software, firmware, or any combination thereof. For example, the subject matter described herein can be implemented in software (e.g., a "function" or "module") executed by a hardware-based processor. In one exemplary implementation, the subject matter described herein can be implemented using a non-transitory computer readable medium having stored thereon executable instructions that when executed by the processor of a computer control the processor to perform steps. Exemplary non-transitory computer readable media suitable for implementing the subject matter described herein can for example comprise chip memory devices or disk memory devices accessible by a processor, programmable logic devices, and application specific integrated circuits. In addition, a computer readable medium that implements the subject matter described herein can be located on a single computing platform or can be distributed across plural computing platforms.

These and other objects of the present disclosure as can become apparent from the disclosure herein are achieved, at least in whole or in part, by the subject matter disclosed herein.

BRIEF DESCRIPTION OF THE DRAWINGS

The features and advantages of the present subject matter will be more readily understood from the following detailed description which should be read in conjunction with the accompanying drawings that are given merely by way of explanatory and non-limiting example, and in which:

FIG. 5 depicts an exemplary table illustrating the numerical association between brightness percentage and gradation steps corresponding to an LED light fixture according to one aspect of the disclosure herein; and FIG. 6 is an exemplary table illustrating the association between different delta values and step time values according to one aspect of the disclosure herein.

DETAILED DESCRIPTION

The subject matter disclosed herein is directed to dynamic light emitting device (LED) lighting control systems and related methods. In one aspect, the present subject matter can comprise a software process to enable the dimming of an LED light source to appear visually smooth by eliminating the visible transitions between brightness levels. For example, a change from a dimming input device, such as a user moving a slider or knob on a manual dimmer, establishes a target brightness level for the LED light source. The software process that controls the brightness can then adjust the illumination level of the LED light source in a manner that traverses through all of the brightness levels exiting between the current brightness light level (e.g., the initial illumination level prior to the user's control input) and the target light level (e.g., the illumination level corresponding to the received control input). Notably, the software process continuously changes the speed or rate at which the process proceeds to each distinct brightness level. In some aspects, the speed can be established by applying a mathematical operation on a delta value, which represents the difference between the current lighting level and the target lighting level. Consequently, the LED light output can quickly track user inputs when the current delta value is large, but can gradually approach the target lighting level as the delta value becomes smaller. This manner of controlling an LED light fixture not only prevents visible steps between brightness levels produced by a digitally-dimmed control system but also improves the aesthetics of the LED light source as a new brightness level is established.

Reference will be made in detail to possible aspects or embodiments of the subject matter herein, one or more examples of which are shown in the figures. Each example is provided to explain the subject matter and not as a limitation. In fact, features illustrated or described as part of one embodiment can be used in another embodiment to yield still a further embodiment. It is intended that the subject matter disclosed and envisioned herein covers such modifications and variations.

Figure 1:
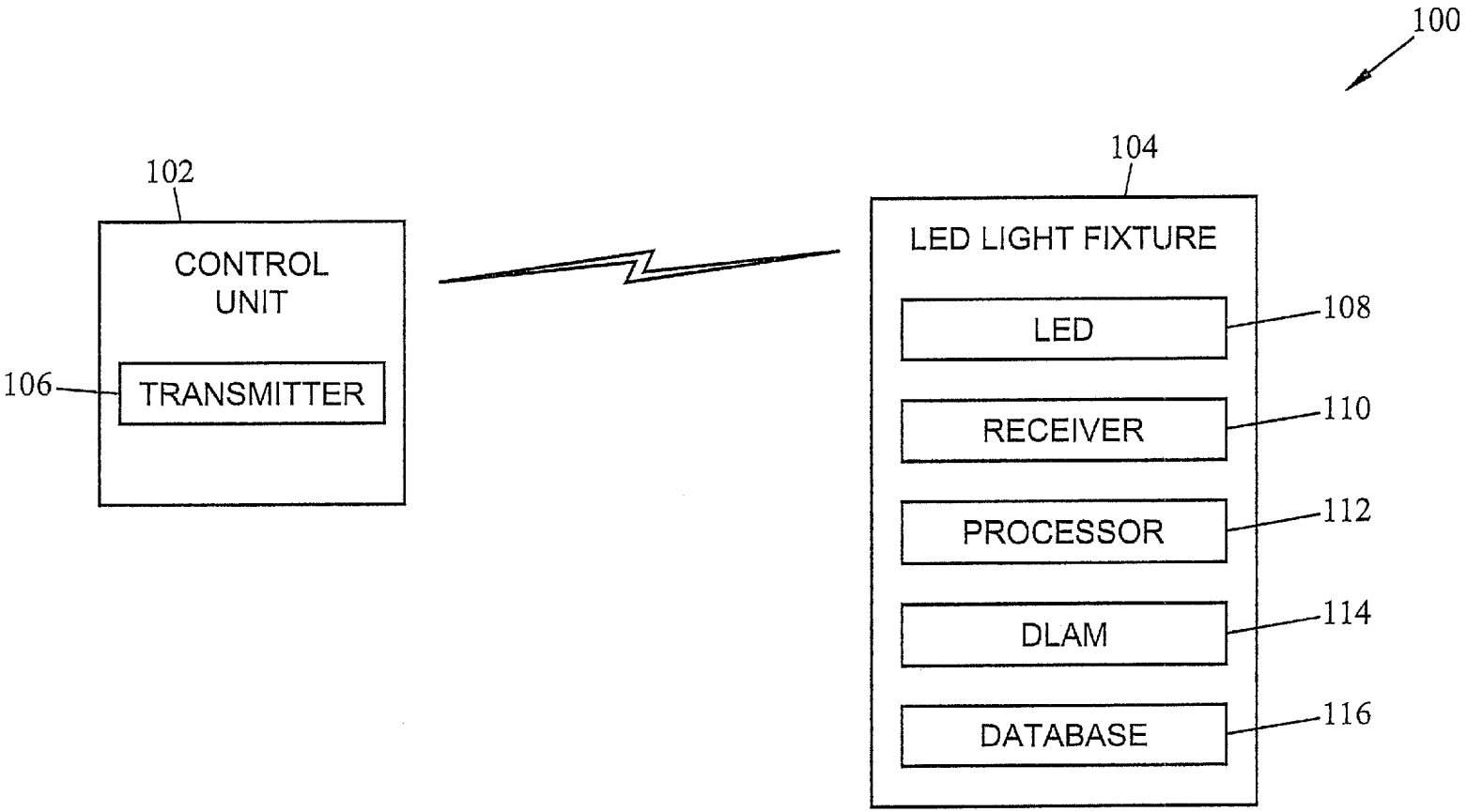
FIG. 1 is a block diagram illustrating a dynamic LED lighting control system according to one aspect of the disclosure herein.

FIG. 1 is a block diagram illustrating dynamic light emitting device (LED) lighting adjustment system according to one aspect of the disclosure herein. Referring to FIG. 1, an exemplary dynamic LED lighting adjustment system generally designated 100 can comprise at least one control unit 102 and at least one LED fixture 104. Although system 100 only depicts a single control unit 102 and a single LED light fixture 104, additional control units and LED light fixtures can be utilized without departing from the scope of the present subject matter. In some aspects, control unit 102 and LED light fixture 104 can be communicatively connected together either via a wireless connection (as shown in FIG. 1) or a wired connection (not shown). Control unit 102 can comprise any type of controlling mechanism utilized by a dimmer switch, knob, slider, or the like. If communicatively connected to LED light fixture 104 via a wireless means, then control unit 102 can be provisioned with a transmitter unit 106. In some aspects, transmitter unit 106 can comprise a radio frequency (RF) transmitter, an infrared transmitter, a WiFi transmitter, or any other like wireless transmitter unit.

Likewise, LED light fixture 104 can be equipped with a receiver unit 110 (e.g., a radio receiver or a wired receiver unit) that can be configured to receive any wireless signal transmitted from transmitter unit 106. Regardless of the manner in which control unit 102 and LED light fixture 104 are communicatively connected, LED light fixture 104 can further comprise an LED 108, a processing unit 112, a dynamic LED adjustment module (DLAM) 114, and database 116. Specifically, LED light fixture 104 can comprise an LED 108, such as an LED diode or chip, which can be at least partially covered such as by a lens or encapsulant. LED light fixture 104 can also comprise a processor such as processing unit 112 (e.g., a microcontroller or microprocessor) and software, such as software-based or firmware-based DLAM 114. In one aspect, processing unit 112 can comprise a microcontroller configured to send a pulse width modulation (PWM) signal to adjust (e.g., increase or decrease) the brightness of LED 108. Processing unit 112 can also comprise a clock timer (e.g., a timer routine and/or function) configured to receive a time value input that determines when the PWM signal is sent. In some aspects, processing unit 112 can utilize DLAM 114 to process a lighting adjustment signal sent by control unit 102. For example, DLAM 114 can be used to compare the current lighting level emitted by LED light fixture 104 with a target lighting level associated with the received lighting adjustment signal. Based on i) a delta value that represents the difference of the current lighting level and the target lighting level and ii) the current brightness level setting (e.g., gradation step) itself, DLAM 114 can modify the received lighting adjustment signal in a manner that produces a smooth illumination transition (e.g., increasing or dimming the LED) as LED lighting fixture adjusts the lighting level from the current lighting level to the target lighting level (e.g., the desired lighting level). Notably, DLAM 114 can be configured to transition or sweep through all the lighting levels between the current lighting level and the target lighting level at a variable rate. In some aspects, DLAM 114 can produce a variable rate that comprises a faster change rate (i.e., the amount of time in which the LED light fixture emits a brightness gradation level/step before being adjusted to the next gradation step) if the current lighting level gradation step is far (i.e., a large numerical difference in gradation steps) from the target lighting level gradation step. DLAM 114 can also be configured to decrease the change rate as the current lighting level gradation step approaches the target lighting level step. An exemplary manner in which DLAM 114 dynamically adjusts the brightness level of LED lighting fixture 104 upon receiving a lighting adjustment signal/command is described in FIG. 2 below.

Figure 2A:
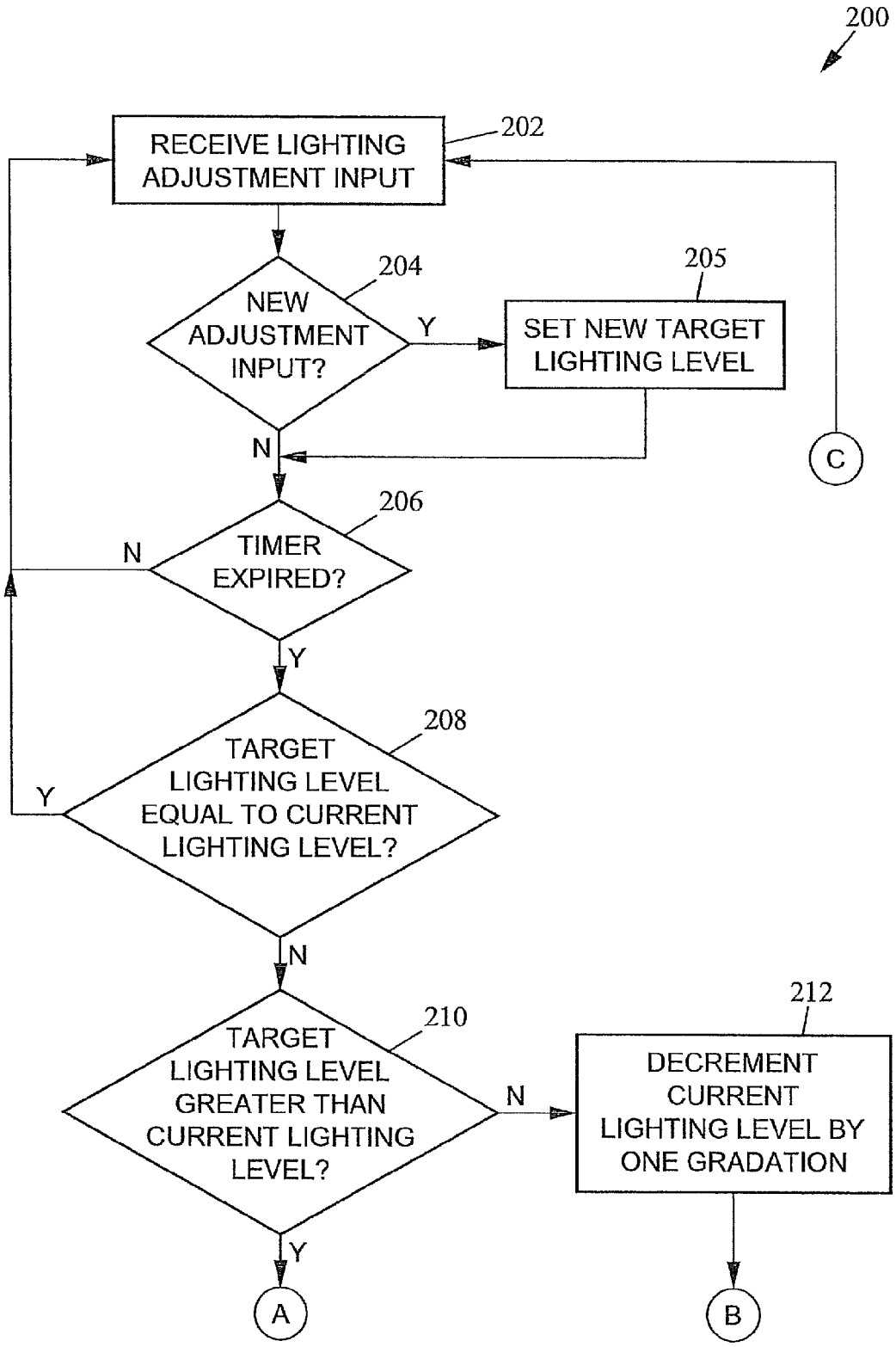
FIGS. 2A and 2B depict a flow chart illustrating a dynamic LED lighting control method according to one aspect of the disclosure herein.
Figure 2B:
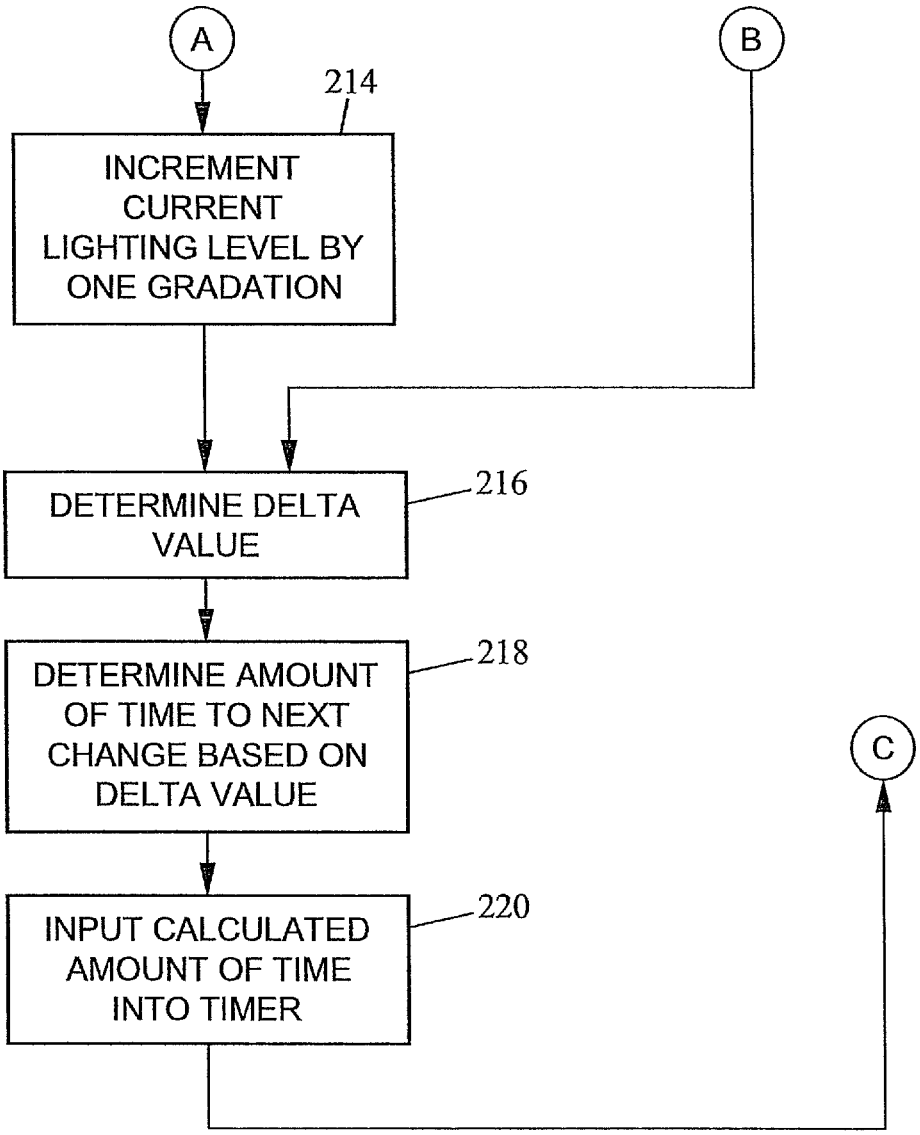
Figure 4:
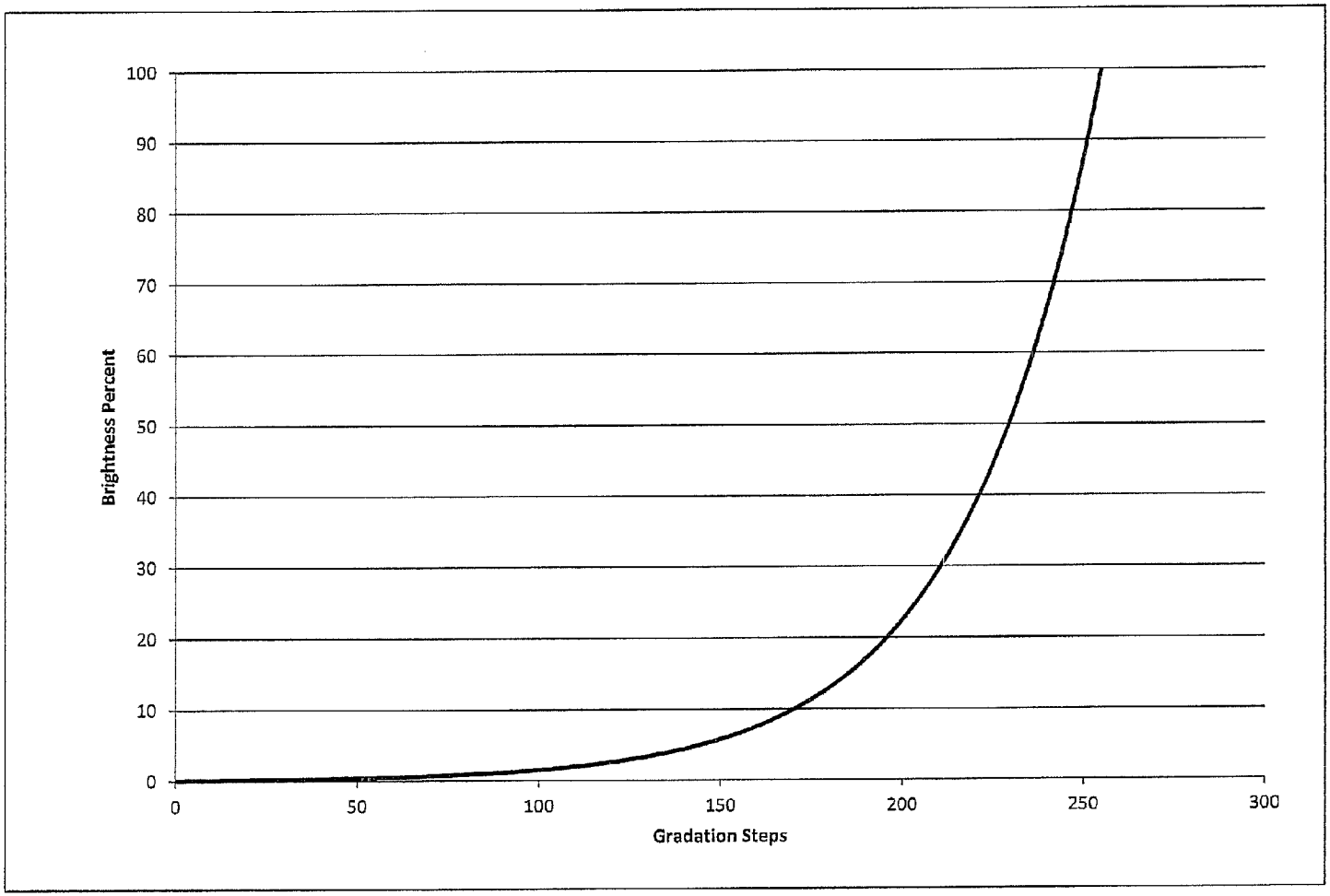
FIG. 4 is a graph illustrating an exemplary association between brightness percentage and gradation steps corresponding to an LED light fixture according to one aspect of the disclosure herein.

FIG. 2 illustrates a flow chart of a method 200 for dynamically adjusting the illumination output of an LED lighting fixture. In some aspects, the steps of method 200 can be implemented upon the execution of DLAM 114 by processing unit 112. Referring to FIG. 2, method 200 can comprise step 202 where a lighting adjustment input is received. In one aspect, a user can adjust a control unit (e.g., control unit 102), such as a dimmer slider, configured to control the illumination output of an LED light fixture. Upon adjusting the dimmer slider, a transmitter unit (e.g., transmitter unit 106) associated with the dimmer switch can be configured to transmit a wireless signal that comprises a lighting adjustment input command to the LED light fixture (e.g., LED light fixture 104). For example, consider a dimmer switch that can be set to any one of 256 level/step settings that corresponds to the lighting gradation level/steps of an LED light fixture (e.g., level settings ranging from 0 to 255 wherein gradation step 0 is off and gradation step 255 is the maximum illumination output of the LED light fixture). To illustrate this aspect, consider FIG. 4 which depicts an exemplary logarithmic curve that visually represents an association of the brightness percent and the lighting gradation steps of an LED light fixture. Similarly, FIG. 5 depicts three separate sections 502-506 of a table that contains the numerical data used to plot the logarithmic curve depicted in FIG. 4. Both FIGS. 4 and 5 illustrate the notion that as the gradation steps increase linearly, the brightness percent of the LED light fixture increases exponentially. Although the example in FIG. 2 describes an embodiment that utilizes 256 gradation steps, any number of gradation steps can be utilized without departing from the scope of the present subject matter.

Returning to the discussion of step 202 in FIG. 2, consider a scenario where the dimmer slider is initially set to a gradation step of 158. In some aspects, the initial $158^{th}$ gradation step can be mapped or associated with a particular lumen level or brightness percentage of the LED light fixture being controlled. For example, referring to either the curve depicted in FIG. 4 or table 500 in FIG. 5, the $158^{th}$ gradation step is depicted as being associated with 7.15 brightness percent of the LED light fixture. Thus, when the LED light fixture is set to the $158^{th}$ gradation step, the light emitted is equal to 7.15% of the maximum illumination output of the LED light fixture. Further suppose that, a user decides to utilize the dimmer slider to increase the current lighting level (e.g., initial lighting level) of the LED light fixture from the $158^{th}$ gradation step to a desired "target" lighting level that corresponds to the $175^{th}$ gradation step. By adjusting the dimmer slider, the user utilizes the control unit to send a lighting adjustment signal containing the target lighting level to the LED light fixture. At this point, method 200 proceeds to step 204 to initiate a number of checks in order to process the lighting adjustment signal.

In step 204, a determination is made as to whether the received lighting adjustment signal is new. In some aspects, step 204 can be an optional step used in wireless control systems. Because a wireless system can inadvertently send a previously transmitted lighting adjustment signal to the LED light fixture, step 204 can function as a reliability check that ensures that the received input command signal is new. If the received lighting adjustment signal is determined to be a new adjustment input, then method 200 can then proceed to step 205 where the input command signal is stored as a new target lighting level. Afterwards, method 200 can continue to step 206. If the received lighting adjustment signal is not a new adjustment input, then method 200 can continue directly to step 206 where a determination is made as to whether a clock timer (e.g., a portion of a processor in the LED light fixture) has expired. In some aspects, the query in block 206 can occur on a continuous basis, regardless of whether a new adjustment input is made (i.e., see block 204). In some aspects, the clock timer mechanism included in the LED light fixture can receive a step time value (explained below) and waits until the step time value expires before proceeding to the steps of method 200. Specifically, if the step time value has not expired, method 200 can loop back up to step 202. If the step time value has expired, then method 200 can continue to step 208.

In step 208, a determination can be made as to whether the target lighting level is equal to the current lighting level. If the two lighting levels match, then the target lighting level has been attained and method 200 can loop back to step 202. Returning to the previous example, once the current lighting level is incremented to the $175^{th}$ gradation step (and thus is equal to the target lighting level of 175), the LED lighting fixture has achieved the desired lighting level.

If the two lighting levels do not match, method 200 can continue to step 210 where a determination can be made as to whether the target lighting level is greater than the current lighting level (i.e., the lighting adjustment signal directs the LED light fixture to increase its brightness level). If the target light level is not greater than the current lighting level, then method 200 can continue to step 212 where the current lighting level can be decremented by one step. However, if the target lighting level is greater than the current lighting level, then method 200 can proceed to step 214 where the current lighting level is incremented by one step. Returning to the previous example, if the current lighting level is equal to 158 and the target lighting level is equal to 175, then the current lighting level can be incremented by one gradation step to a new current lighting level of 159. Notably, the brightness percentage of the LED light fixture is increased from 7.15% to 7.35% (see FIG. 4 or 5).

In step 216, a delta value is determined. In some aspects, the delta value can be equal to the magnitude or absolute value of the numerical difference between the current lighting level and the target lighting level. Continuing with the example presented above, the delta value would equal 16, which is equal to the absolute value of the difference of 159 (i.e., the "new" current lighting level) and 175 (i.e., the target lighting level).

In step 218, the amount of time (i.e., a step time value) before the next gradation change can be determined. In some aspects, processing unit 112 executing DLAM 114 can calculate an amount of time in which the LED light fixture emits light at the current lighting level before the current lighting level is incremented to the next gradation level/step (i.e., a "new" current lighting level). In one aspect, the delta value can be received by or used in a mathematical formula or a polynomial as an input to determine a step time value. In another aspect, the delta value can be used to query a lookup table to obtain a step time value. Returning to the previous example, the delta value of 16 can be used to query a lookup table, such as table 500 depicted in FIG. 6. As shown in FIG. 6, a time value of 12.096 milliseconds corresponds with a delta value of 16.

In step 220, the calculated amount of time is input into the timer. In one aspect, the determined step time value can be used as input for the clock timer utilized in step 206. For example, the step time value of 12.096 milliseconds can be provided as input to the clock timer in LED lighting device 104. Once the time value of 12.096 milliseconds expires, then the comparison of the current lighting level and the target lighting level can be made. The method 200 then can loop back to step 202.

Upon looping back to step 202, method 200 can continue until the target lighting level is achieved. Notably, each iteration of method 200 can adjust the current lighting level closer to the target lighting level by one step or level (i.e., increments or decrements by one step). During each iteration of method 200, the LED light fixture can be illuminated to the brightness percentage corresponding to the new current lighting level for an amount of time corresponding to the new calculated/determined step time value (which is based on the current delta value).

Figure 3A:
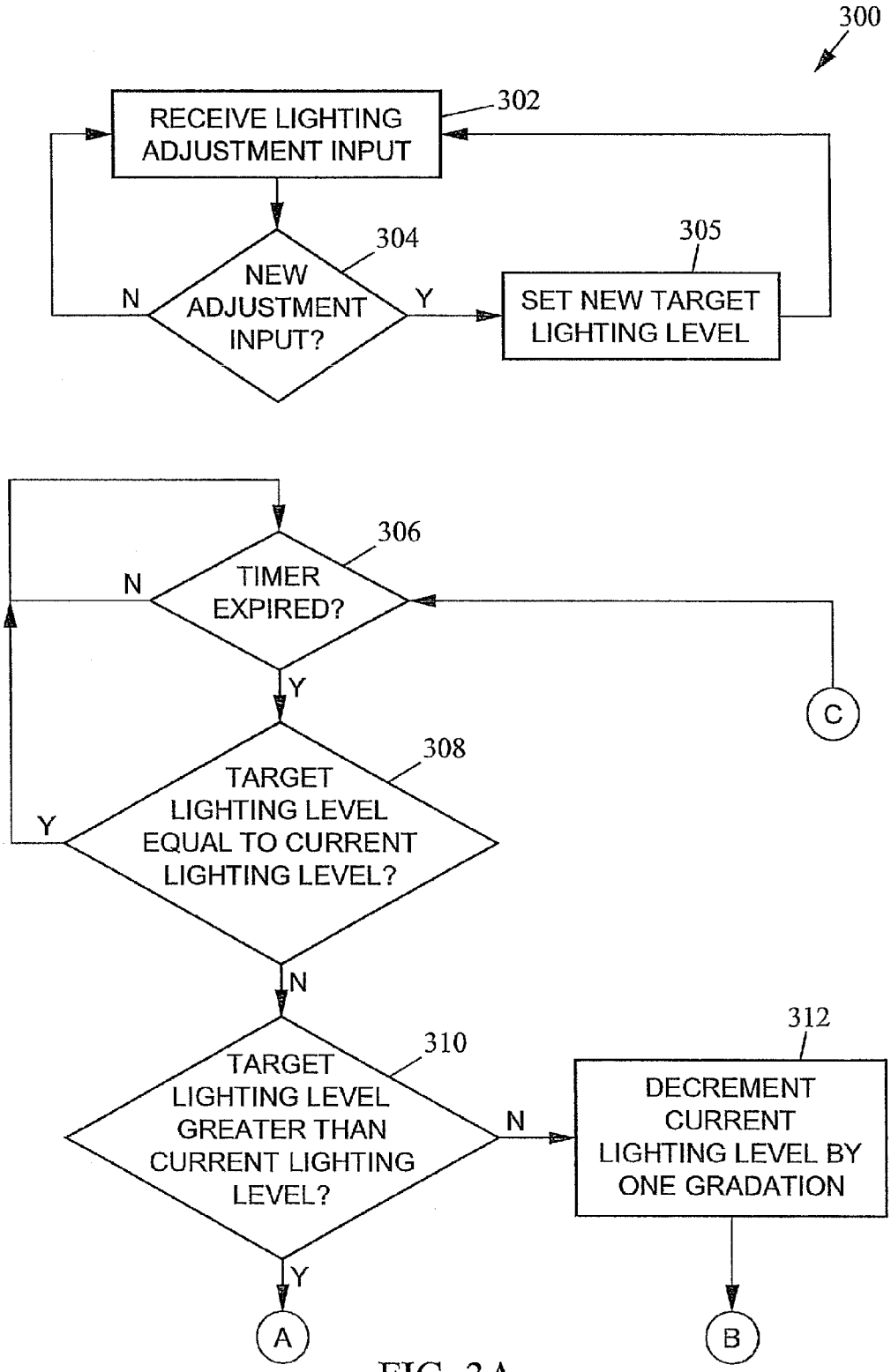
FIGS. 3A and 3B depict a flow chart illustrating a second dynamic LED lighting control method according to one aspect of the disclosure herein.
Figure 3B:
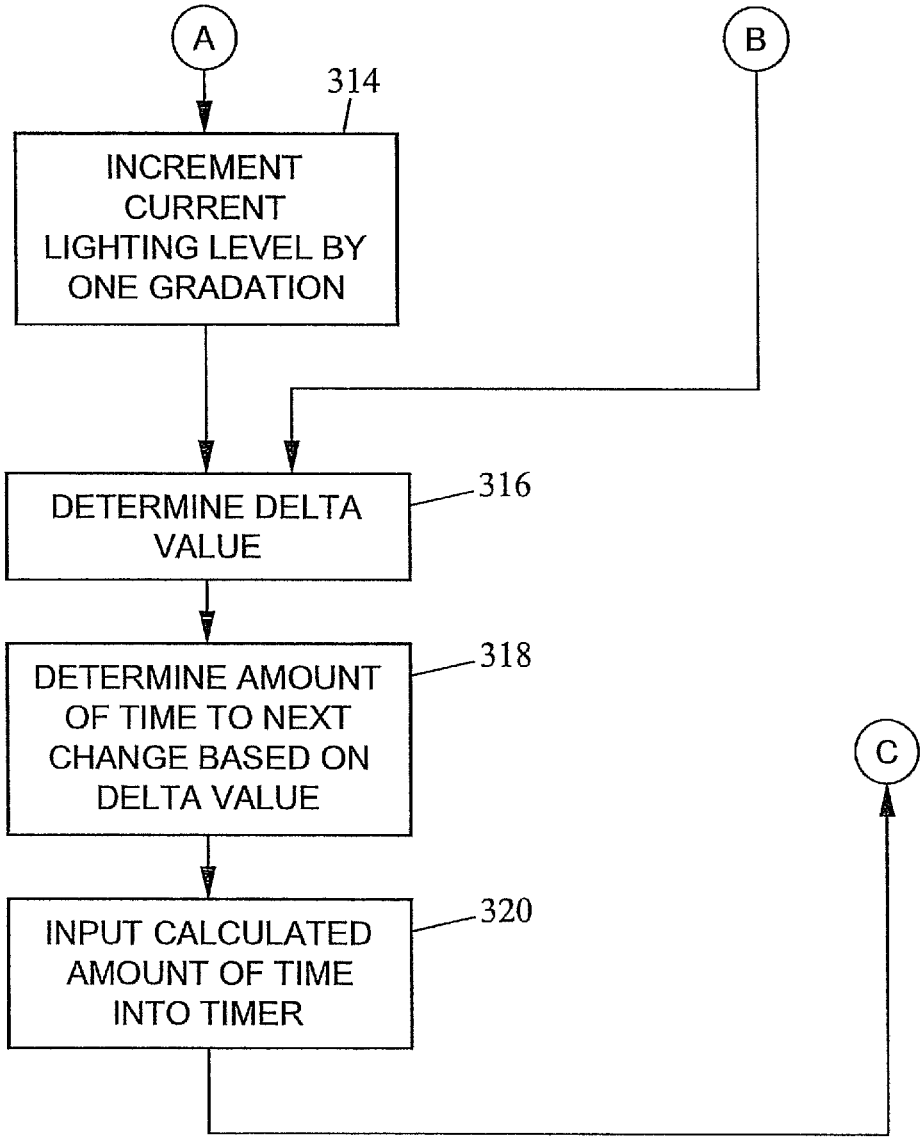

FIG. 3 illustrates a flow chart of a method 300 for dynamically adjusting the illumination output of an LED lighting fixture. In some aspects, the steps of method 300 can be implemented upon execution of DLAM 114 by processing unit 112. Referring to FIG. 3, it should be noted that method 300 largely resembles to method 200 with the exception that method 300 utilizes two separate and simultaneous processes or routines (as opposed to the single process/routine of method 200). In some aspects, DLAM 114 can utilize an "interrupt routine function" to handle the clock timer. For example, the clock timer can be configured to run on a periodic basis, which occasionally interrupts the main routine. Referring to FIG. 3, a first process including steps 302, 304, and 305 can be configured to execute on a continuous basis. Similarly, a second process including steps 306-320 can be configured to execute in parallel with the first process. In one aspect, processing unit 112 can execute both the first process and the second process in an alternating manner such that the two separate processes seem to run simultaneously or contemporaneously.

In one aspect, method 300 comprises a step 302 where a lighting adjustment input is received. In one aspect, a user can adjust a control unit (e.g., control unit 102), such as a dimmer slider, configured to control the illumination output of an LED light fixture. Upon adjusting the dimmer slider, a transmitter unit (e.g., transmitter unit 106) associated with the dimmer switch can be configured to transmit a wireless signal that comprises a lighting adjustment input command to the LED light fixture (e.g., LED light fixture 104). Notably, step 302 is identical to step 202 in method 200 of FIG. 2 as discussed above.

In step 304, a determination as to whether the received lighting adjustment signal is new can be made. In some aspects, step 304 can be an optional step used in wireless control systems. If the received light adjustment signal is determined not to be a new lighting adjustment input, then method 300 can simply return to step 302 and wait for the receiving of a new lighting adjustment input. If the received lighting adjustment signal is determined to be a new lighting adjustment input in step 304, then method 300 can then proceed to step 305 where the input command signal is stored as a new target lighting level. In the event a new target lighting level is set, DLAM 114 can be configured to utilize the new target lighting level in the second process. For example, DLAM 114 can utilize the new target lighting level to compare with the current lighting level value in step 308.

Referring to the second process of FIG. 3, step 306 comprises a determination of whether the clock timer (e.g., a portion of a processor in the LED light fixture) has expired. In one aspect, step 306 comprises a periodic check to determine if the clock timer has expired. In some aspects, the clock timer mechanism included in the LED light fixture can receive a step time value (explained below) and waits until the step time value expires before proceeding to the steps of method 300. Specifically, if the step time value has expired, then method 300 can continue to step 308. Otherwise, method 300 loops back to step 306 until a new target lighting level is received.

Upon determining that the target lighting level is not equal to the current lighting level at step 308, method 300 continues to step 310. At this stage, steps 310-320 of method 300 proceed in a manner identical to steps 210-220 (as described above) of method 200 with the exception that step 320 loops back to step 306 (as opposed to step 220 looping back to step 202).

As mentioned above, FIG. 4 is a graph illustrating an exemplary association between brightness percent and lighting gradation steps corresponding to an LED light fixture according to one aspect of the disclosure herein. As shown in FIG. 4, a logarithmic curve represents an association between an LED light fixture's 256 gradation steps (e.g., gradation steps 0 to 255) to the percentage of total light brightness produced by the same LED light fixture. Specifically, the logarithmic curve in FIG. 4 illustrates that at lower gradation steps (i.e., gradation steps 0 to 150), less than 10% of the LED light fixture's illumination is emitted. However, as the gradation steps increase linearly, the brightness percent of the LED light fixture increases exponentially. For example, nearly 80 percent of the brightness percent of the LED light fixture is emitted during gradation steps 200 to 255 (i.e., 56 steps). Notably, a logarithmic curve or polynomial can be utilized to effectively determine the rate in which the brightness of the LED light fixture is increased since a human eye typically perceives increases in light brightness at lower illumination levels than at higher illumination levels. Specifically, in order for the human eye to perceive a gradual and steady increase in brightness, the increase of illumination brightness must be conducted at a variable rate (i.e., smaller increases of brightness at lower gradation steps and larger jumps of brightness at higher gradation steps). Although a scale of 0 to 255 gradation level/steps are depicted in FIG. 4, any number of gradation steps can be utilized without departing from the scope of the present subject matter.

As mentioned above, FIG. 5 depicts portions of an exemplary association between brightness percent and lighting gradation steps corresponding to an LED light fixture according to one aspect of the disclosure herein. Notably, FIG. 5 comprises three separate sections 502-506 of a table that contains the numerical data used to plot the logarithmic curve depicted in FIG. 4. Section 502 comprises brightness percentage data associated with gradation steps 0-25. Notably, less than a 0.10 percent increase in brightness is associated with the increase from gradation step 0 to gradation step 25. In contrast, section 504 illustrates almost a 6 percent increase in brightness that corresponds to the increase from gradation step 151 to gradation step 176. Moreover, section 506 illustrates a nearly 50 percent increase in brightness that is associated with the increase from gradation step 230 to gradation step 255. Although FIG. 5 depicts data that is used to produce the exemplary logarithmic curve shown in FIG. 4, other types of exponential, polynomial, and logarithmic equations can be used to generate plot point tables not unlike those provided in FIG. 5.

FIG. 6 is an exemplary table illustrating the mapping of the gradation step delta and step times according to one aspect of the disclosure herein. Referring to FIG. 6, table 600 comprises a pulse width modulation (PWM) delta column 602 and a step time column 604. Notably, PWM delta column 602 lists a plurality of "delta values" that represent the absolute value of the difference between a target lighting gradation step and a current lighting gradation step. For example, suppose a control unit associated with an LED light fixture is initially set to a current lighting gradation step/setting (e.g., an initial lighting gradation step/setting) equal to 155 and a user subsequently adjusts a dimmer switch associated with the control unit to lower the illumination level emitted by the LED light fixture to a target lighting gradation step equal to 140. In this scenario, the delta value would equal to 15. Similarly, if the control unit associated with an LED light fixture is initially set to a current lighting gradation step (or setting) equal to 155 and a user subsequently adjusts a dimmer switch associated with the control unit to increase the illumination level emitted by the LED light fixture to a target lighting gradation step equal to 170, the absolute value of delta value would also equal 15.

Regardless of whether the delta value is negative or positive, it should be noted that only the absolute value or magnitude of the calculated delta value is of importance. Namely, the delta value is used to determine the amount of time (i.e., step time) in which the LED light fixture maintains a particular level of brightness before being incremented (or decremented) to the next gradation step. For example, if the delta value is equal to 15, then the associated step time value is equal to 12.608 milliseconds (ms). More specifically, the LED light fixture displays the current lighting level for 12.608 milliseconds before being incremented (or decremented) to the next gradation step. Notably, the next gradation step will be associated with a delta equal to 14, thus indicating an increased step time value equal to 13.12 milliseconds. Notably, by utilizing a lookup table such as table 600 to recalculate the step time at each gradation step, the present subject matter is able to increase or decrease the brightness level of an LED light fixture at a variable rate (i.e., instead of a constant rate). Although FIG. 6 illustrates an exemplary table 600 that contain 32 predefined data points, it is understood that more or less data points can be utilized without departing from the scope of the present subject matter.

While the subject matter herein has been has been described in reference to specific aspects, features, and/or illustrative embodiments, it will be appreciated that the utility of the described subject matter is not thus limited, but rather extends to and encompasses numerous other variations, modifications and alternative embodiments, as will suggest themselves to those of ordinary skill in the field of the present subject matter, based on the disclosure herein. Various combinations and sub-combinations of the structures and features described herein are contemplated and will be apparent to a skilled person having knowledge of this disclosure. Any of the various features and elements as disclosed herein can be combined with one or more other disclosed features and elements unless indicated to the contrary herein. Correspondingly, the subject matter as hereinafter claimed is intended to be broadly construed and interpreted, as including all such variations, modifications and alternative embodiments, within its scope and including equivalents of the claims.

What is claimed is:

1. A method for dynamically controlling a light emitting device (LED) lighting fixture, comprising:

receiving, at an LED lighting fixture, a lighting adjustment signal corresponding to a target lighting level;

determining a delta value that represents a difference between a current lighting level of the LED lighting fixture and the target lighting level and a step time value associated with the determined delta value, wherein the step time value increases as the delta value reduces in magnitude; and adjusting the current lighting level of the LED lighting fixture to a new current lighting level for the duration of the step time value.

2. The method of claim 1, comprising repeating the determining and adjusting steps until the new current lighting level equals the target lighting level.

3. The method of claim 1, wherein the delta value comprises a difference of gradation steps existing between the current lighting level and the target lighting level.

4. The method of claim 3, wherein adjusting the current lighting level further comprises increasing the current lighting level to the new current lighting level, wherein the new current lighting level comprises a single gradation step greater than the current lighting level.

5. The method of claim 3, wherein adjusting the current lighting level further comprises decreasing the current lighting level to the new current lighting level, wherein the new current lighting level comprises a single gradation step less than the current lighting level.

6. The method of claim 1, wherein determining the delta value comprises subtracting the current lighting level from the target lighting level.

7. The method of claim 1, wherein the step time value is determined by using the delta value to query a lookup table.

8. The method of claim 1, wherein the step time value is determined by using a mathematical formula that receives the delta value as an input.

9. The method of claim 1, wherein adjusting the current lighting level comprises emitting light from the LED light fixture at a brightness percentage value determined by using the new current lighting level to either utilize a lookup table or a mathematical formula.

10. The method of claim 9, wherein the lookup table is configured to be missing entries such that one or more gradation steps are skipped.

11. The method of claim 1, wherein adjusting the current lighting level comprises emitting light from the LED light fixture at a brightness percentage value determined by using the new current lighting level to reference either a logarithmic curve or a polynomial.

12. The method of claim 1, wherein the lighting adjustment signal is received from a control unit via either a wireless connection or a wired connection.

13. A dynamic light emitting device (LED) lighting adjustment system comprising:

an LED light fixture comprising:

a receiver unit configured to receive a lighting adjustment signal corresponding to a target lighting level; and a dynamic lighting adjustment module configured to:

determine a delta value that represents a difference between a current lighting level of the LED lighting fixture and the target lighting level and a step time value associated with the determined delta value, wherein the step time value increases as the delta value reduces in magnitude; and adjust the current lighting level of the LED lighting fixture to a new current lighting level for the duration of the step time value.

14. The system of claim 13, wherein the dynamic lighting adjustment module is further configured to repeatedly determine the delta value and step time value and adjust the current lighting level of the LED lighting fixture until the new current lighting level equals the target lighting level.

15. The system of claim 13, wherein the delta value comprises a difference of gradation steps existing between the current lighting level and the target lighting level.

16. The system of claim 15, wherein the dynamic lighting adjustment module is further configured to increase the current lighting level to the new current lighting level, wherein the new current lighting level comprises a single gradation step greater than the current lighting level.

17. The system of claim 15, wherein the dynamic lighting adjustment module is further configured to decrease the current lighting level to the new current lighting level, wherein the new current lighting level comprises a single gradation step less than the current lighting level.

18. The system of claim 13, wherein the dynamic lighting adjustment module is further configured to calculate the delta value by subtracting the current lighting level from the target lighting level.

19. The system of claim 13, wherein the step time value is determined by using the delta value to query a lookup table.

20. The system of claim 13, wherein the step time value is determined by using a mathematical formula that receives the delta value as an input.

21. The system of claim 13, wherein the dynamic lighting adjustment module is further configured to instruct the LED light fixture to emit light at a brightness percentage value determined by using the new current lighting level to either utilize a lookup table or a mathematical formula.

22. The system of claim 21, wherein the lookup table is configured to be missing entries such that one or more gradation steps are skipped.

23. The system of claim 13, wherein the dynamic lighting adjustment module is further configured to instruct the LED light fixture to emit light at a brightness percentage value determined by using the new current lighting level to reference either a logarithmic curve or a polynomial curve.

24. The system of claim 13, wherein a control unit is configured to send the lighting adjustment signal via either a wireless connection or a wired connection.

25. A non-transitory computer readable medium having stored thereon comprising computer executable instructions that, when executed by a processor of a computer, performs steps comprising:

receiving, at a light emitting device (LED) lighting fixture, a lighting adjustment signal corresponding to a target lighting level;

determining a delta value that represents a difference between a current lighting level of the LED lighting fixture and the target lighting level and a step time value associated with the determined delta value, wherein the step time value increases as the delta value reduces in magnitude; and adjusting the current lighting level of the LED lighting fixture to a new current lighting level for the duration of the step time value.

26. The computer readable medium of claim 25, comprising repeating the determining and adjusting steps until the new current lighting level equals the target lighting level.

27. A method for dynamically controlling a light emitting device (LED) lighting fixture, comprising:

receiving, at an LED lighting fixture, a lighting adjustment signal corresponding to a target lighting level;

determining a delta value that represents a difference between an initial lighting level of the LED lighting fixture and the target lighting level; and adjusting a lighting level of the LED lighting fixture from the initial lighting level to the target lighting level at a rate that decreases as the lighting level approaches the target lighting level, wherein the rate is determined using a mathematical formula that receives the delta value as an input.

28. The method of claim 27, wherein the delta value comprises a difference of gradation steps existing between the initial lighting level and the target lighting level.

29. The method of claim 28, wherein adjusting the lighting level includes decreasing the rate at which the lighting level is adjusted as a difference between the gradation steps decreases.

30. The method of claim 27, wherein the rate is determined using the delta value to query a lookup table.

31. A dynamic light emitting device (LED) lighting adjustment system comprising:

an LED light fixture comprising:

a receiver unit configured to receive a lighting adjustment signal corresponding to a target lighting level; and a dynamic lighting adjustment module configured to:

determine a delta value that represents a difference between an initial lighting level of the LED lighting fixture and the target lighting level using a mathematical formula that receives the delta value as an input; and adjust a lighting level of the LED lighting fixture from the initial lighting level to the target lighting level at a rate that decreases as the lighting level approaches the target lighting level.

32. The system of claim 31, wherein the delta value comprises a difference of gradation steps existing between the initial lighting level and the target lighting level.

33. The system of claim 32, wherein the dynamic lighting adjustment module is further configured to decrease the rate at which the lighting level is adjusted as a difference between the gradation steps decrease.

34. The system of claim 31, wherein the dynamic lighting adjustment module is further configured to determine the rate using the delta value to query a lookup table.

* * * * *